US010692464B2

(12) United States Patent
Yang et al.

(10) Patent No.: US 10,692,464 B2
(45) Date of Patent: Jun. 23, 2020

(54) VOLTAGE SUPPLY UNIT AND METHOD, DISPLAY DRIVING CIRCUIT AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Kun Yang, Beijing (CN); Chunyang Nie, Beijing (CN); Ke Dai, Beijing (CN); Lei Guo, Beijing (CN); Shenghua Hu, Beijing (CN); Ruilian Li, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/453,134

(22) Filed: Jun. 26, 2019

(65) Prior Publication Data

US 2020/0135135 A1 Apr. 30, 2020

(30) Foreign Application Priority Data

Oct. 24, 2018 (CN) ..... 2018 1 1241896

(51) Int. Cl.
*G09G 3/36* (2006.01)

(52) U.S. Cl.
CPC ..... *G09G 3/3696* (2013.01); *G09G 2330/027* (2013.01)

(58) Field of Classification Search
None
See application file for complete search history.

(56) References Cited

U.S. PATENT DOCUMENTS 5,602,463 A * 2/1997 Bendall ..... G05F 1/62 323/266
2004/0174725 A1* 9/2004 Fujiyoshi ..... H02M 3/3382 363/56.01

* cited by examiner

*Primary Examiner* — Parul H Gupta
(74) *Attorney, Agent, or Firm* — Westman, Champlin & Koehler, P.A.

(57) ABSTRACT

A voltage supply unit includes a control circuit, a capacitor circuit and a unidirectionally-conductive circuit. The control circuit controls an output end of the control circuit to be electrically connected to a first input end or a second input end of the control circuit under the control of a voltage signal from a first voltage output end. The capacitor circuit controls a potential at a first input end. When a difference between a first level and a potential at the first input end is greater than or equal to a predetermined on-state voltage, the unidirectionally-conductive circuit allows a unidirectional current flowing from a first level end to a first end thereof, and when the difference between the first level and the potential at the first input end is smaller than the predetermined on-state voltage, controls the first level end to be electrically disconnected from the first input end.

13 Claims, 2 Drawing Sheets

VOLTAGE SUPPLY UNIT AND METHOD, DISPLAY DRIVING CIRCUIT AND DISPLAY DEVICE

CROSS-REFERENCE TO RELATED APPLICATION

The present application claims a priority of the Chinese patent application No. 201811241896.7 filed on Oct. 24, 2018, which is incorporated herein by reference in its entirety.

TECHNICAL FIELD

The present disclosure relates to the field of display technology, in particular to a voltage supply unit, a voltage supply method, a display driving circuit and a display device.

BACKGROUND

Along with the wide application of a large-size, high-resolution thin film transistor-liquid crystal display (TFT-LCD), more and more Gate On Array (GOA) units and pixels need to be driven through circuits, resulting in larger and larger load of a display panel. Hence, an output driving capability of a level shift is highly demanded.

Such a defect as shutdown afterimage occurs during a reliability test of a 75-inch 8K display panel. As required by a design sequence of the display panel, when the display panel is shut down, the level shifter needs to enable a voltage signal VGL from a low voltage output end, a first high voltage signal VDDO, a second high voltage signal VDDE and a clock signal CLK to be each at a high level. Through analyzing the display panel with the shutdown afterimage, it is found that the voltage signal VGL from the low voltage output end and a gate driving signal are both at a low level when the display panel is shutdown. At this time, it is impossible for charges inside the display panel to be released completely, and thereby the shutdown afterimage may occur.

SUMMARY

In one aspect, the present disclosure provides in some embodiments a voltage supply unit, including a control circuit, a capacitor circuit and a unidirectionally-conductive circuit. A control end of the control circuit is connected to a first voltage output end, a first input end of the control circuit is connected to a first end of the capacitor circuit, a second input end of the control circuit is connected to a second level end, and an output end of the control circuit is configured to provide a voltage. The control circuit is configured to control the output end to be electrically connected to the first input end or the second input end under the control of a voltage signal from the first voltage output end. The first end of the capacitor circuit is connected to a first end of the unidirectionally-conductive circuit, and a second end of the capacitor circuit is connected to the control end. The capacitor circuit is configured to control a potential at the first input end. A second end of the unidirectionally-conductive circuit is connected to a first level end. The unidirectionally-conductive circuit is configured to, when a difference between a first level inputted by the first level end and a potential at the first end of the unidirectionally-conductive circuit is greater than or equal to a predetermined on-state voltage, allow a unidirectional current flowing from the first level end to the first end of the unidirectionally-conductive circuit to flow therethrough, and when the difference between the first level and the potential at the first end of the unidirectionally-conductive circuit is smaller than the predetermined on-state voltage, control the first level end to be electrically disconnected from the first end of the unidirectionally-conductive circuit.

In a possible embodiment of the present disclosure, the control circuit includes a first control transistor and a second control transistor. A control electrode of the first control transistor is connected to the control end, a first electrode of the first control transistor is connected to the first input end, and a second electrode of the first control transistor is connected to the output end. A control electrode of the second control transistor is connected to the control end, a first electrode of the second control transistor is connected to the second input end, and a second electrode of the second control transistor is connected to the output end.

In a possible embodiment of the present disclosure, the first control transistor is an NPN-type triode, an n-type Thin Film Transistor (TFT) or a Negative Metal-Oxide-Semiconductor (NMOS) transistor, and the second control transistor is a PNP-type triode, a p-type TFT or a Positive Metal-Oxide-Semiconductor (PMOS) transistor.

In a possible embodiment of the present disclosure, the capacitor circuit includes a storage capacitor, or at least two storage capacitors connected in parallel to each other. A first end of the storage capacitor is connected to the first end of the unidirectionally-conductive circuit, and a second end of the storage capacitor is connected to the control end.

In a possible embodiment of the present disclosure, a capacitance of the storage capacitor is greater than or equal to 100 μF.

In a possible embodiment of the present disclosure, the storage capacitor is an electrolytic capacitor.

In a possible embodiment of the present disclosure, the unidirectionally-conductive circuit includes a control diode, the first end of the unidirectionally-conductive circuit is a cathode of the control diode, and the second end of the unidirectionally-conductive circuit is an anode of the control diode. The anode of the control diode is connected to the first level end, and the cathode of the control diode is connected to the first end of the capacitor circuit.

In a possible embodiment of the present disclosure, the predetermined on-state voltage is a threshold voltage of the control diode.

In a possible embodiment of the present disclosure, the first voltage output end is a first voltage output end of a level shifter, the first level is a high level provided by a power source management integrated circuit, and the second level is a low level provided by the power source management integrated circuit.

In another aspect, the present disclosure provides in some embodiments a voltage supply method for applying a voltage to a display panel through the above-mentioned voltage supply unit. The voltage supply method includes: within a display time period, outputting, by the first voltage output end, a first voltage signal, and controlling, by the control circuit, the output end of the control circuit to be electrically connected to the second input end of the control circuit, so as to enable a unidirectional current flowing from the first level end to the first end of the unidirectionally-conductive circuit to flow through the unidirectionally-conductive circuit to charge the capacitor circuit, thereby to pull up the potential at the first input end of the control circuit, until the unidirectionally-conductive circuit controls the first level end to be electrically disconnected from the unidirectionally-conductive circuit; and within a shutdown time period, outputting, by the first voltage output end, a second voltage signal, and controlling, by the control circuit, the output end of the control circuit to be electrically connected to the first input end of the control circuit.

In yet another aspect, the present disclosure provides in some embodiments a display driving circuit including the above-mentioned voltage supply unit.

In still yet another aspect, the present disclosure provides in some embodiments a display device including the above-mentioned display driving circuit.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, TFTs, field effect transistors (FETs) or any other elements having a similar characteristic. In order to differentiate two electrodes other than a control electrode from each other, one of the two electrodes is called as first electrode and the other is called as second electrode.

In actual use, when the transistor is a triode, the control electrode may be a base, the first electrode may be a collector and the second electrode may be an emitter; or the control electrode may be a base, the first electrode may be an emitter and the second electrode may be a collector.

In actual use, when the transistor is a TFT or FET, the control electrode may be a gate electrode, the first electrode may be a drain electrode and the second electrode may be a source electrode; or the control electrode may be a gate electrode, the first electrode may be a source electrode and the second electrode may be a drain electrode.

Figure 1:
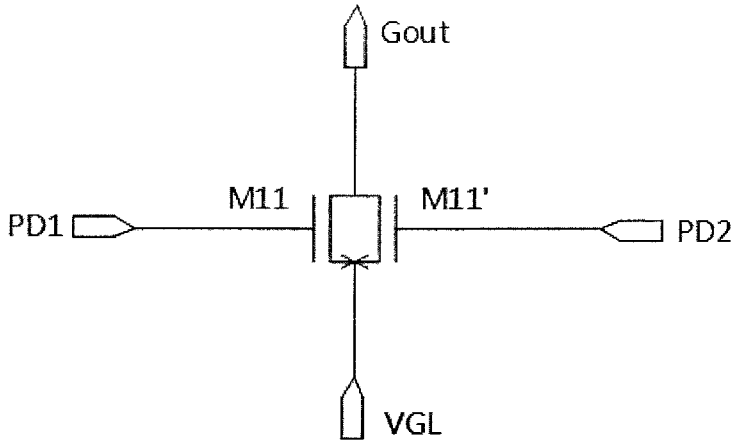
FIG. 1 is a schematic view showing a shift register unit including two transistors.

As shown in FIG. 1, M11 represents a first transistor, M11' represents a second transistor, and M11 and M12 are both n-type transistors. A gate electrode of M11 is connected to a first pull-down node PD1, and a gate electrode of M11' is connected to a second pull-down node PD2. When a display panel is shut down, a potential at PD1 may be pulled up by a first high voltage signal VDDE, and a potential at PD2 may be pulled up by a second high voltage signal VDDO, so as to turn on M11 and M11', thereby to write VGL into a gate driving signal output end Gout. When the display panel is shut down, a voltage of a gate driving signal from Gout may depend on a pulled-up voltage of VGL. A 75-inch 8K display panel has a very large load, and when it is shut down, a large current may be extracted from an output end of a level shifter instantaneously. Due to the limitation of a current driving capability of a VGL output channel of the level shifter, it is impossible for the pull-up voltage of VGL to reach an ideal value, and thereby a shutdown afterimage may occur.

The present disclosure provides in some embodiments a voltage supply unit, which includes a control circuit, a capacitor circuit and a unidirectionally-conductive circuit. A control end of the control circuit is connected to a first voltage output end, a first input end of the control circuit is connected to a first end of the capacitor circuit, a second input end of the control circuit is connected to a second level end, and an output end of the control circuit is configured to provide a voltage. The control circuit is configured to control the output end to be electrically connected to the first input end or the second input end under the control of a voltage signal from the first voltage output end. The first end of the capacitor circuit is connected to a first end of the unidirectionally-conductive circuit, and a second end of the capacitor circuit is connected to the control end. The capacitor circuit is configured to control a potential at the first input end. A second end of the unidirectionally-conductive circuit is connected to a first level end. The unidirectionally-conductive circuit is configured to, when a difference between a first level inputted by the first level end and a potential at the first end of the unidirectionally-conductive circuit is greater than or equal to a predetermined on-state voltage, allow a unidirectional current flowing from the first level end to the first end of the unidirectionally-conductive circuit to flow therethrough, and when the difference between the first level and the potential at the first end of the unidirectionally-conductive circuit is smaller than the predetermined on-state voltage, control the first level end to be electrically disconnected from the first end of the unidirectionally-conductive circuit.

In the embodiments of the present disclosure, the first end of the capacitor circuit, the first end of the unidirectionally-conductive circuit and the first end of the control circuit may be connected to each other.

During the operation of the voltage supply unit, within a display time period, the first voltage output end may output a first voltage signal, and the control circuit may control the output end of the control circuit to be electrically connected to the second input end of the control circuit. At this time, the unidirectional current flowing from the first level end to the unidirectionally-conductive circuit may flow through the unidirectionally-conductive circuit, so as to charge the capacitor circuit, and pull up the potential at the first end of the capacitor circuit, i.e., pull up the potential at the first input end of the control circuit, until the unidirectionally-conductive circuit controls the first level end to be electrically disconnected from the first end of the unidirectionally-conductive circuit. Within a shutdown time period, the first voltage output end may output a second voltage signal, and the control circuit may control the output end of the control circuit to be electrically connected to the first input end of the control circuit. A voltage across the capacitor circuit cannot be changed suddenly, so the capacitor circuit may bootstrap the potential at the first input end, so as to pull up the voltage applied by the output end. In addition, through the capacitor circuit, it is able to increase a driving current flowing from the first input end of the control circuit to the output end of the control circuit and then to a voltage end of the display panel, thereby to prevent the occurrence of the shutdown afterimage.

In actual use, the first voltage signal may be, but not limited to, a low voltage signal, and the second voltage signal may be, but not limited to, a high voltage signal.

During the implementation, the first voltage output end may be a first voltage output end of a level shifter, the first level may be a high level VGH-PMIC applied by a Power Source Management Integrated Circuit (PMIC), and the second level may be a low level VGL-PMIC applied by the PMIC. The output end of the control circuit may be connected to a low end input end VGL-PANEL of the display panel, and a voltage may be applied to the display panel through VGL-PANEL.

In actual use, the first voltage output end may be a low voltage output end VGL-LS of the level shifter. Within the display time period, the low voltage output end VGL-LS may output a low voltage VGL (e.g., −5V), and within the shutdown time period, the voltage applied by the low voltage output end VGL-LS may be pulled up. For example, the voltage applied by the low voltage output end VGL-LS within the shutdown time period may be 10V to 15V. However, this voltage is still insufficient to cause charges in the display panel to be released completely.

Figure 2:
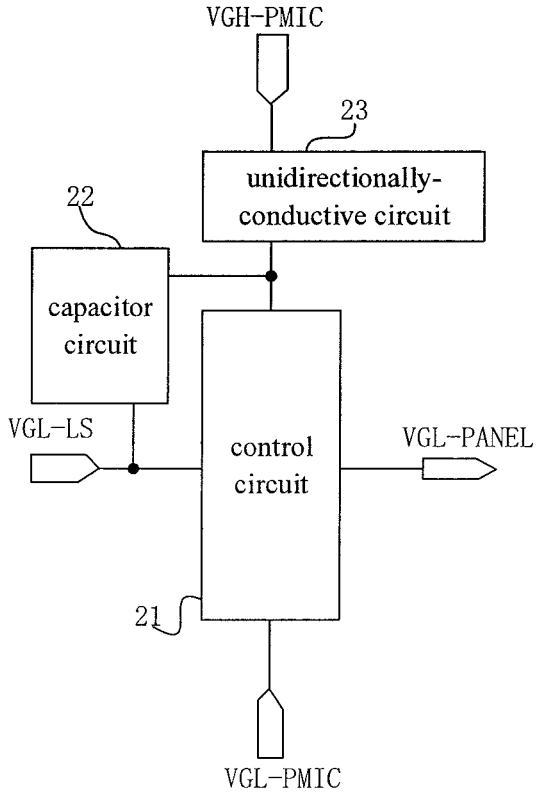
FIG. 2 is a schematic view showing a voltage supply unit according to one embodiment of the present disclosure.

As shown in FIG. 2, the voltage supply unit may include a control circuit 21, a capacitor circuit 22 and a unidirectionally-conductive circuit 23.

A control end of the control circuit 21 may be connected to the low voltage output end VGL-LS of the level shifter, a first input end of the control circuit 21 may be connected to a high level end through the unidirectionally-conductive circuit 23, a second input end of the control circuit 21 may be connected to a low level end, and an output end of the control circuit 21 may be connected to the low voltage input end VGL-PANEL of the display panel. The high level end is configured to receive the high level VGH-PMIS from the PMIC, and the low level end is configured to receive the low level VGL-PMIC from the PMIS.

The control circuit 21 is configured to control the output end to be electrically connected to the first input end or the second input end under the control of a voltage signal from the low voltage output end VGL-LS of the level shifter.

A first end of the capacitor circuit 22 may be connected to the first input end, and a second end of the capacitor circuit 22 may be connected to the control end. The capacitor circuit 22 is configured to control a potential at the first input end.

The unidirectionally-conductive circuit 23 is configured to, when a difference between the high level VGH-PMIC and the potential at the first end of the unidirectionally-conductive circuit 23 is greater than or equal to a predetermined on-state voltage, allow a unidirectional current flowing from the high level end to the unidirectionally-conductive circuit 23 to flow therethrough, and when the difference between the high level VGH-PMIC and the potential at the first end of the unidirectionally-conductive circuit 23 is smaller than the predetermined on-state voltage, control the high level end to be electrically disconnected from the first end of the unidirectionally-conductive circuit 23.

In actual use, the predetermined on-state voltage may be set according to the practical need. When the unidirectionally-conductive circuit 23 includes a control diode, the predetermined on-state voltage may be just a threshold voltage of the control diode.

When a difference between a voltage applied to an anode of the control diode and a voltage applied to a cathode of the control diode is greater than or equal to the threshold voltage of the control diode, the control diode may be in an on state, so as to allow a current to flow from the anode to the cathode. When the difference between the voltage applied to the anode of the control diode and the voltage applied to the cathode of the control diode is smaller than the threshold voltage of the control diode, the control diode may be in an off state, and at this time, there is almost no current flowing through the control diode.

During the operation of the voltage supply unit in FIG. 2, within the display time period, VGL-LS may output the low voltage VGL, and the control circuit 21 may control its output end to be electrically connected to its second input end, so as to control VGL-PANEL to output VGL-PMIC. The unidirectional current flowing from the high level end to the first end of the unidirectionally-conductive circuit 23 may flow through the unidirectionally-conductive circuit 23, so as to charge the capacitor circuit 22, thereby to pull up the potential at the first end of the capacitor circuit 22, until the unidirectionally-conductive circuit 23 controls the high level end to be electrically disconnected from the first end of the unidirectionally-conductive circuit 23.

Within the shutdown time period, VGL-LS may output a high voltage, and the control circuit 21 may control its output end to be electrically connected to its first input end. A voltage across the capacitor circuit 22 cannot be changed suddenly, so the capacitor circuit 22 may bootstrap the potential at the first end of the capacitor circuit 22, i.e., bootstrap the potential at the first input end, thereby to pull up the voltage applied by the output end to VGL-PANEL. In addition, through the capacitor circuit 22, it is able to increase a driving current flowing from the first input end of the control circuit 21 to VGL-PANEL and then to a voltage end of the display panel.

In actual use, through the voltage supply unit in the embodiments of the present disclosure, the voltage applied by the control circuit 21 to VGL-PANEL may be up to 25V within the shutdown time period.

To be specific, the control circuit may include a first control transistor and a second control transistor. A control electrode of the first control transistor may be connected to the control end, a first electrode of the first control transistor may be connected to the first input end, and a second electrode of the first control transistor may be connected to the output end. A control electrode of the second control transistor may be connected to the control end, a first electrode of the second control transistor may be connected to the second input end, and a second electrode of the second control transistor may be connected to the output end.

During the implementation, the first control transistor may be an NPN-type triode, an n-type TFT or an NMOS transistor, and the second control transistor may be a PNP-type triode, a p-type TFT or a PMOS transistor.

To be specific, the capacitor circuit may include a storage capacitor, or at least two storage capacitors connected in parallel to each other. A first end of the storage capacitor may be connected to the first end of the unidirectionally-conductive circuit, and a second end of the storage capacitor may be connected to the control end.

In actual use, the first end of the storage capacitor may be further connected to the first input end of the control circuit.

In a possible embodiment of the present disclosure, a capacitance of the storage capacitor may be greater than or equal to 100 μF.

In a possible embodiment of the present disclosure, the capacitance of the storage capacitor may be provided with a relatively large value, so as to generate a large current through a relatively small voltage change ($I=C*dU/dt$, where I represents the current flowing through the storage capacitor, C represents the capacitance of the storage capacitor, U represents a voltage across the storage capacitor, and t represents time).

In actual use, the storage capacitor may be, but not limited to, an electrolytic capacitor (which may have a relatively large capacitance).

During the implementation, the unidirectionally-conductive circuit may include a control diode, the first end of the unidirectionally-conductive circuit may be a cathode of the control diode, and the second end of the unidirectionally-conductive circuit may be an anode of the control diode. The anode of the control diode may be connected to the first level end, and the cathode of the control diode may be connected to the first end of the capacitor circuit.

To be specific, the first voltage output end may be a first voltage output end of a level shifter, the first level may be provided by a power source management integrated circuit, and the second level received by the second level end may be provided by the power source management integrated circuit.

Figure 3:
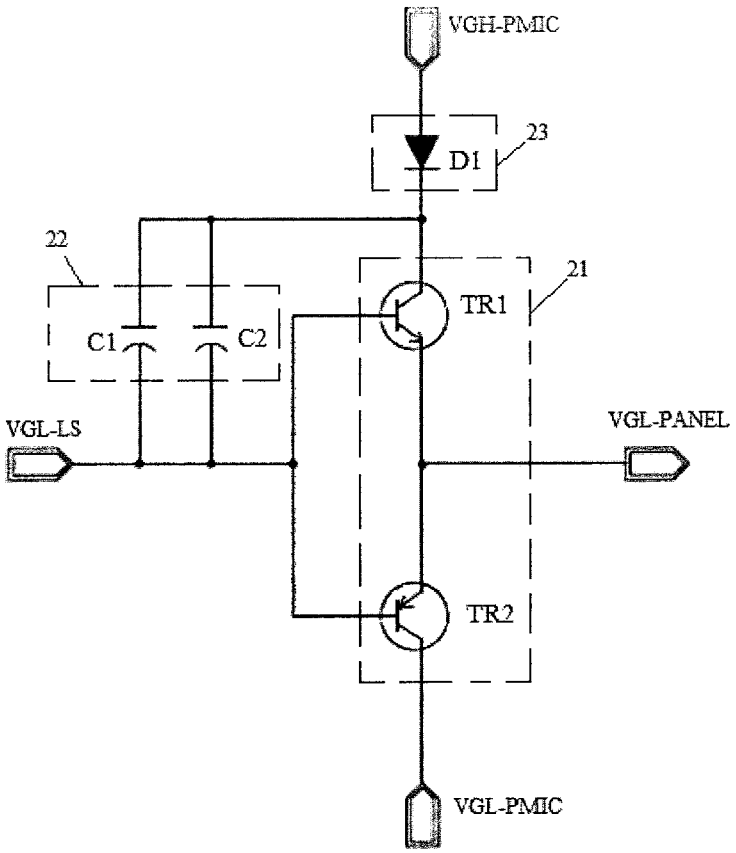
FIG. 3 is a circuit diagram of the voltage supply unit according to one embodiment of the present disclosure.

As shown in FIG. 3, in a possible embodiment of the present disclosure, the voltage supply unit may include the control circuit 21, the capacitor circuit 22 and the unidirectionally-conductive circuit 23. The control end of the control circuit 21 may be connected to the low voltage output end VGL-LS of the level shifter.

The control circuit 21 may include a first control transistor TR1 and a second control transistor TR2. A base of the first control transistor TR1 may be connected to the control end, a collector of the first control transistor TR1 may be connected to the first input end of the control circuit 21, and an emitter of the first control transistor TR2 may be connected to the output end of the control circuit 21. A base of the second control transistor TR2 may be connected to the control end, a collector of the second control transistor TR2 may be connected to the second input end of the control circuit 21, and an emitter of the second control transistor TR2 may be connected to the output end of the control circuit 21.

The output end of the control circuit 21 may be connected to the display panel through the low voltage input end VGL-PANEL, and a voltage may be applied to the display panel through the VGL-PANEL.

The second input end of the control circuit 21 may be connected to a low level end, and the low level end is configured to receive the low level VGL-PMIC from the PMIC.

The capacitor circuit 22 may include a first storage capacitor C1 and a second storage capacitor C2 connected in parallel to each other. A first end of C1 and a first end of C2 may be both connected to the collector of TR1, and a second end of C1 and a second end of C2 may be both connected to VGL-LS.

The unidirectionally-conductive circuit 23 may include a control diode D1, an anode of which is connected to a high level end and a cathode of which is connected to the collector of TR1. The high level end is configured to receive the high level VGH-PMIC from the PMIC.

In FIG. 3, TR1 may be, but not limited to, an NPN-type triode, and TR2 may be, but not limited to, a PNP-type triode.

In FIG. 3, C1 and C2 may be both electrolytic capacitors, and a capacitance of each of C1 and C2 may be, but not limited to, 200 μF.

Figure 4:
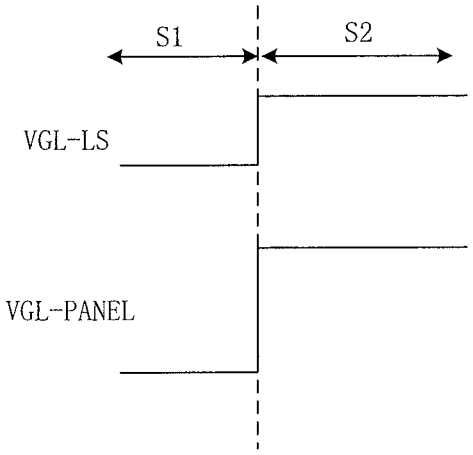
FIG. 4 is a time sequence diagram of the voltage supply unit according to one embodiment of the present disclosure.

As shown in FIG. 4, during the operation of the voltage supply unit in FIG. 3, within a display time period S1, the display panel may operate normally, and VGL-LS of the level shifter may output a low voltage. At this time, TR2 may be turned on, and TR1 may be turned off, so VGL-PANEL may be driven by VGL-PMMIC. D1 may be turned on, and C1 and C2 may be charged by VGH-PMIC via D1, so as to pull up the potential at the collector of TR1 until D1 is in the off state.

Within a shutdown time period S2, when the display panel is shut down, the voltage from VGL-LS of the level shifter may be pulled up. At this time, TR1 may be turned on, and TR2 may be turned off, so VGL-PANEL may be driven by VGH-PMIC. In addition, the voltage across the capacitor circuit cannot be changed suddenly, so the voltage applied to the collector of TR1 may be bootstrapped, and a driving voltage instantaneously applied to VGL-PANEL during the shutdown may be pulled up simultaneously. In addition, C1 and C2 are each a large-capacitance electrolytic capacitor, so a load transient current requirement may be met by C1 and C2 merely through a very tiny voltage change. When the display panel is shut down, the current may flow from the first end of C1 and the first end of C2 to the collector of TR1, then to the emitter of TR1, and then to VGL-PANEL.

Due to the limitation of volume and heat dissipation effect, it is impossible for an MOSFET built in the level shifter to provide a large driving current for the VGL output channel, and it is impossible to provide a sufficient large pulled-up voltage of VGL when the display panel is shut down. Hence, in the embodiments of the present disclosure, the voltage signal from the low voltage output end VGL-LS of the level shifter may be taken as a control signal. VGL-LS may output different voltage signals when the display panel is in an operating state and in a shutdown state, so as to control an on state and an off state of the two add-on triodes, thereby to directly drive the display panel through the PMIC that generates VGH-PMIC and VGL-PMIC. In this way, it is able to effectively improve the current driving capability of VGL-PANEL. Furthermore, a large-capacitance electrolytic capacitor may be added between the high level end generating VGH-PMIC and VGL-LS, so as to bootstrap the driving voltage on the basis of the principle that the voltage across the large-capacitance electrolytic capacitor cannot be changed suddenly when the display panel is shut down.

The voltage supply unit in the embodiments of the present disclosure has the following advantages. Original hardware architecture of the display panel may not be changed, so it is able to reduce the manufacture cost as compared with a conventional scheme where a structure of a GOA unit is modified. In addition, the add-on triodes and a bootstrapping capacitor may be added on a circuit board, so it is able to bootstrap the driving voltage as well as the driving current for the VGL output channel of the level shifter when the display panel is shut down, thereby to prevent the occurrence of afterimages during the reliability test of the display panel. Furthermore, it is unnecessary to provide any complex circuit processing chip, so it is able to reduce the manufacture cost and improve the practicability.

The present disclosure further provides in some embodiments a voltage supply method for applying a voltage to a display panel through the above-mentioned voltage supply unit. The voltage supply method includes: within a display time period, outputting, by the first voltage output end, a first voltage signal, and controlling, by the control circuit, the output end of the control circuit to be electrically connected to the second input end of the control circuit, so as to enable a unidirectional current flowing from the first level end to the first end of the unidirectionally-conductive circuit to flow through the unidirectionally-conductive circuit to charge the capacitor circuit, thereby to pull up the potential at the first input end of the control circuit, until the unidirectionally-conductive circuit controls the first level end to be electrically disconnected from the first end of the unidirectionally-conductive circuit; and within a shutdown time period, outputting, by the first voltage output end, a second voltage signal, and controlling, by the control circuit, the output end of the control circuit to be electrically connected to the first input end of the control circuit.

According to the voltage supply method in the embodiments of the present disclosure, it is able to increase the driving voltage and the driving current applied by the output end of the control circuit to the display panel when the display panel is shut down, thereby to prevent the occurrence of shutdown afterimages.

The present disclosure further provides in some embodiments a display driving circuit including the above-mentioned voltage supply unit.

The present disclosure further provides in some embodiments a display device including the above-mentioned driving circuit.

The display device may be any product or member having a display function, e.g., mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A voltage supply unit, comprising a control circuit, a capacitor circuit and a unidirectionally-conductive circuit, wherein a control end of the control circuit is connected to a first voltage output end, a first input end of the control circuit is connected to a first end of the capacitor circuit, a second input end of the control circuit is connected to a second level end, and an output end of the control circuit is configured to provide a voltage;

the control circuit is configured to control the output end to be electrically connected to the first input end or the second input end under the control of a voltage signal from the first voltage output end;

the first end of the capacitor circuit is connected to a first end of the unidirectionally-conductive circuit, and a second end of the capacitor circuit is connected to the control end;

the capacitor circuit is configured to control a potential at the first input end;

a second end of the unidirectionally-conductive circuit is connected to a first level end; and the unidirectionally-conductive circuit is configured to, when a difference between a first level inputted by the first level end and a potential at the first end of the unidirectionally-conductive circuit is greater than or equal to a predetermined on-state voltage, allow a unidirectional current flowing from the first level end to the first end of the unidirectionally-conductive circuit to flow therethrough, and when the difference between the first level and the potential at the first end of the unidirectionally-conductive circuit is smaller than the predetermined on-state voltage, control the first level end to be electrically disconnected from the first end of the unidirectionally-conductive circuit.

2. The voltage supply unit according to claim 1, wherein the control circuit comprises a first control transistor and a second control transistor, wherein a control electrode of the first control transistor is connected to the control end, a first electrode of the first control transistor is connected to the first input end, and a second electrode of the first control transistor is connected to the output end; and a control electrode of the second control transistor is connected to the control end, a first electrode of the second control transistor is connected to the second input end, and a second electrode of the second control transistor is connected to the output end.

3. The voltage supply unit according to claim 2, wherein the first control transistor is an NPN-type transistor, an n-type Thin Film Transistor (TFT) or a Negative Metal-Oxide-Semiconductor (NMOS) transistor, and the second control transistor is a PNP-type transistor, a p-type TFT or a Positive Metal-Oxide-Semiconductor (PMOS) transistor.

4. The voltage supply unit according to claim 1, wherein the capacitor circuit comprises a storage capacitor, wherein a first end of the storage capacitor is connected to the first end of the unidirectionally-conductive circuit, and a second end of the storage capacitor is connected to the control end.

5. The voltage supply unit according to claim 1, wherein the capacitor circuit comprises at least two storage capacitors connected in parallel to each other, wherein a first end of each storage capacitor is connected to the first end of the unidirectionally-conductive circuit, and a second end of each storage capacitor is connected to the control end.

6. The voltage supply unit according to claim 4, wherein a capacitance of the storage capacitor is greater than or equal to 100 μF.

7. The voltage supply unit according to claim 4, wherein the storage capacitor is an electrolytic capacitor.

8. The voltage supply unit according to claim 1, wherein the unidirectionally-conductive circuit comprises a control diode, the first end of the unidirectionally-conductive circuit is a cathode of the control diode, and the second end of the unidirectionally-conductive circuit is an anode of the control diode, wherein the anode of the control diode is connected to the first level end, and the cathode of the control diode is connected to the first end of the capacitor circuit.

9. The voltage supply unit according to claim 8, wherein the predetermined on-state voltage is a threshold voltage of the control diode.

10. The voltage supply unit according to claim 1, wherein the first voltage output end is a first voltage output end of a level shifter, the first level is a high level provided by a power source management integrated circuit, and the second level is a low level provided by the power source management integrated circuit.

11. A voltage supply method for applying a voltage to a display panel through the voltage supply unit according to claim 1, wherein the voltage supply method comprises:

within a display time period, outputting, by the first voltage output end, a first voltage signal, and controlling, by the control circuit, the output end of the control circuit to be electrically connected to the second input end of the control circuit, so as to enable a unidirectional current flowing from the first level end to the first end of the unidirectionally-conductive circuit to flow through the unidirectionally-conductive circuit to charge the capacitor circuit, thereby to pull up the potential at the first input end of the control circuit, until the unidirectionally-conductive circuit controls the first level end to be electrically disconnected from the first end of the unidirectionally-conductive circuit; and within a shutdown time period, outputting, by the first voltage output end, a second voltage signal, and controlling, by the control circuit, the output end of the control circuit to be electrically connected to the first input end of the control circuit.

12. A display driving circuit, comprising the voltage supply unit according to claim 1.

13. A display device, comprising the display driving circuit according to claim 12.

* * * * *